US005711262A

United States Patent [19]

Ban et al.

[11] Patent Number: 5,711,262

[45] Date of Patent: Jan. 27, 1998

[54] VISCOUS FLUID TYPE HEAT GENERATOR

[75] Inventors: Takashi Ban; Hidefumi Mori; Kiyoshi Yagi, all of Kariya, Japan

[73] Assignee: Kabushiki Kaisha Toyoda Jidoshokki Seisakusho, Kariya, Japan

[21] Appl. No.: 711,123

[22] Filed: Sep. 9, 1996

[30] Foreign Application Priority Data

Sep. 11, 1995 [JP] Japan ..... 7-232691

[51] Int. Cl.[6] ..... F02N 17/02; F22B 3/06

[52] U.S. Cl. ..... 123/142.5 R; 122/26; 126/247; 123/41.14

[58] Field of Search ..... 123/142.5 R, 41.14, 123/41.12, 502; 122/26; 126/247

[56] References Cited

U.S. PATENT DOCUMENTS

| | | | |
|---|---|---|---|
| 4,531,488 | 7/1985 | Kawamura et al. | 123/300 |
| 4,974,778 | 12/1990 | Bertling | 237/12.3 B |
| 4,993,377 | 2/1991 | Itakura | 123/142.1 R |
| 5,199,539 | 4/1993 | Kikuchi | 192/60 |
| 5,573,184 | 11/1996 | Martin | 237/12.3 R |

*Primary Examiner*—Willis R. Wolfe
*Assistant Examiner*—Hieu T. Vo
*Attorney, Agent, or Firm*—Burgess, Ryan and Wayne

[57] ABSTRACT

A viscous fluid type heat generator is provided with a case unit having a front case and a rear case and has an inner surface defining a heat generating chamber, a heat receiving chamber formed in at least one of the front case and the rear case so as to extend contiguously with the heat generating chamber to form a heat exchanging fluid passage through which a heat exchanging fluid is circulated, a drive shaft supported for rotation in a bearing on the front case, a rotor element mounted on the drive shaft for rotation together with the drive shaft in the heat generating chamber, a viscous fluid filling up a space between the inner surface of the case defining the heating chamber and the outer surface of the rotor for heat generation by the rotation of the rotor element, and a connecting unit for connecting the rotor element to the drive shaft so that the rotor element is unable to turn relative to the drive shaft but is able to incline to the axis of the drive shaft and to move axially on the drive shaft. The connecting unit may be a spline fitting, a one-flat fitting or a two-flat fitting.

7 Claims, 5 Drawing Sheets

VISCOUS FLUID TYPE HEAT GENERATOR

BACKGROUND OF THE INVENTION

1. Field of the Invention

The present invention relates to a viscous fluid type heat generator of the type in which viscous fluid is subjected to a shearing action by a rotating body so as to generate heat to be absorbed by a heat exchanging liquid, typically, water, flowing through a heat receiving chamber. The heat absorbed by the heat exchanging liquid can be used as a heat generating source incorporated in, for example, a heating system or a climate control system of an automobile or other vehicle.

2. Related Art

U.S. Pat. No. 4,993,377 to M. Itakura discloses a viscous fluid type heat generator employed in an automobile heating system. In the prior art viscous fluid type heat generator of U.S. Pat. No. '377, a front and a rear case placed opposite to each other are fastened together with through-bolts to define an internal heat generating chamber and a heat receiving chamber surrounding the heat generating chamber. Water supplied through an inlet port into the heat receiving chamber flows through the heat receiving chamber and is delivered through an outlet port to an external heating circuit. A drive shaft is supported for rotation in bearings on the front case, and a rotor is fixedly mounted on the drive shaft so as to rotate in the heat generating chamber. Ridges and furrows are formed in the inner surface of a case defining the heat generating chamber and the outer surface of the rotor to form a labyrinth, and the labyrinth is filled up with a viscous fluid, such as silicone oil.

When the drive shaft of the viscous fluid type heat generator incorporated into an automobile heating system is driven by an engine, the rotor rotates in the heat generating chamber, and the viscous fluid is subjected to a shearing action in the labyrinth between the inner surface of the case defining the heat generating chamber and the outer surface of the rotor, so that heat is generated. The heat is transferred to the water flowing through the heat receiving chamber and the thus heated water can be used by the heating circuit for heating the passenger compartment of the automobile or other vehicle.

However, it was found that interference between the outer surface of the rotor and the inner surface of the case defining the heat generating chamber are liable to occur in this prior art viscous fluid type heat generator when improvements are incorporated into the viscous fluid type heat generator to increase the quantity of heat generated by every full turn of the rotor. In the viscous fluid type heat generator of this type, a belt tension acts inevitably on a pulley included in a solenoid clutch or a pulley directly mounted on the drive shaft due to the variation of engine speed or the like during operation and hence the drive shaft is inclined inevitably to an ideal shaft while the same is driven. Besides, the drive shaft and the rotor are not perfectly perpendicular to each other, the axes of the rotor and the heat generating chamber are not perfectly parallel to each other, and the axial dimensions of the rotor and the heat generating chamber do not match perfectly due to tolerances permitted on the dimensions of the components of the heat generator.

Therefore, the rotor is inclined from a normal position thereof with respect to the heat generating chamber because the rotor is fixed to the drive shaft, the rotor and the heat generating chamber remain misaligned and, consequently, the outer surface of the rotor and the inner surface of the case defining the heat generating chamber are liable to interfere with each other. If the clearance between the inner surface of the case defining the heat generating chamber and the outer surface of the rotor is increased, the shearing action on the viscous fluid is reduced, whereby the quantity of heat generated by every full turn of the rotor is reduced.

SUMMARY OF THE INVENTION

An object of the present invention is, therefore, to provide a viscous fluid type heat generator capable of preventing interference between the outer surface of a rotor and the inner surface of a case defining a heat generating chamber, to secure that a large quantity of heat is generated by every full turn of the rotor.

In accordance with the present invention, there is provided a viscous fluid type heat generator which comprises:

- a case unit having a front and a rear case, and having an inner surface defining, therein, a heat generating chamber;
- a heat receiving chamber formed in at least one of the front and rear cases so as to extend contiguously with the heat generating chamber to form a heat exchanging fluid passage through which a heat exchanging fluid is circulated;
- a drive shaft supported via a bearing by the front case to be rotatable about an axis of rotation thereof;
- a rotor element mounted on the drive shaft for rotation together with the drive shaft in the heat generating chamber;
- a viscous fluid filling up a space between the inner surface of a case unit defining the heating chamber and the outer surface of the rotor element for heat generation by the rotation of the rotor element; and
- a connecting unit for connecting the rotor element to the drive shaft so that the rotor element is unable to turn relative to the drive shaft but is able to incline to the axis of the drive shaft and to move axially on the drive shaft.

In the above-described viscous fluid type heat generator of the present invention, the rotor element rotates in the heat generating chamber when the drive shaft rotates because the rotor element is restrained from turning relative to the drive shaft, and the rotor element exerts a shearing action on the viscous fluid to make the viscous fluid generate heat. The heat thus generated is used for heating.

In the above-mentioned viscous fluid type heat generator, even if the axis of the drive shaft is inclined to the axis of the heat generating chamber and the axial dimensions of the rotor element and the heat generating chamber do not match each other due to tolerances permitted on the dimensions of those components, the inclination of the axis of the rotor element is absorbed because the rotor element is able to incline relative to the drive shaft, and a difference between the respective dimensions of the rotor element and the heat generating chamber is absorbed because the rotor element is axially movable on the drive shaft.

Accordingly, in the above-mentioned viscous fluid type heat generator, the outer surface of the rotor element and the inner surface of the case unit defining the heat generating chamber can hardly interfere with each other even if the clearance between the outer surface of the rotor element and the inner surface of the case defining the heat generating chamber is reduced to some extent to increase the quantity of heat generated by every full turn of the rotor element.

The connecting unit may be a spline fitting, a one-flat fitting, two-flat fitting or a key fitting.

In the above-described viscous fluid type heat generator, the viscous fluid is confined in a space between the outer surface of the rotor element and the inner surface of the case unit defining the heat generating chamber in a state where the axis of rotation of the rotor element is inclined to that of the drive shaft or the rotor element is dislocated axially. Thus, the viscous fluid held in the space between the outer surface of the rotor element and the inner surface of the case defining the heat generating chamber in a state where the axis of the rotor element is inclined to that of the drive shaft or the rotor element is dislocated axially prevents contact between the outer surface of the rotor element and the inner surface of the case defining the heat generating chamber.

In the viscous fluid type heat generator, the rear case may be provided with a control chamber communicating with a central region of the heat generating chamber and capable of varying its volume, and the volume of the control chamber may be increased to reduce the heat generation by the Weissenberg effect of the viscous fluid. The viscous fluid may be held in the space between the outer surface of the rotor element and the inner surface of the case unit defining the heat generating chamber in a state where either the axis of rotation of the rotor element is inclined to that of the drive shaft or the rotor element is axially dislocated.

The viscous fluid is caused to turn in a direction perpendicular to the liquid surface while the rotor element is rotated and the volume of the control chamber is increased to reduce the heat generation by the movement of the viscous fluid toward the axis against centrifugal force caused by the Weissenberg effect.

It is considered that the Weissenberg effect is developed by normal stress. Since the viscous fluid contained in the heating chamber is recovered into the control chamber in this viscous fluid type heat generator, the quantity of heat generated in the space between the outer surface of the rotor element and the inner surface of the case defining the heat generating chamber is reduced and thereby the heating capacity is reduced.

In the viscous fluid type heat generator, interference between the outer surface of the rotor element and the inner surface of the case defining the heat generating chamber can be prevented by the viscous fluid surely held, in the central region of the space between the outer surface of the rotor element and the inner surface of the case defining the heat generating chamber, by the Weissenberg effect.

BRIEF DESCRIPTION OF THE DRAWINGS

The above and other objects, features, and advantages of the present invention will become more apparent from the ensuing description, taken in conjunction with the accompanying drawings, wherein.

DETAILED DESCRIPTION OF THE PREFERRED EMBODIMENTS

(First Embodiment)

A viscous fluid type heat generator in a first embodiment according to the present invention will be described with reference to FIGS. 1 to 3.

Figure 1:
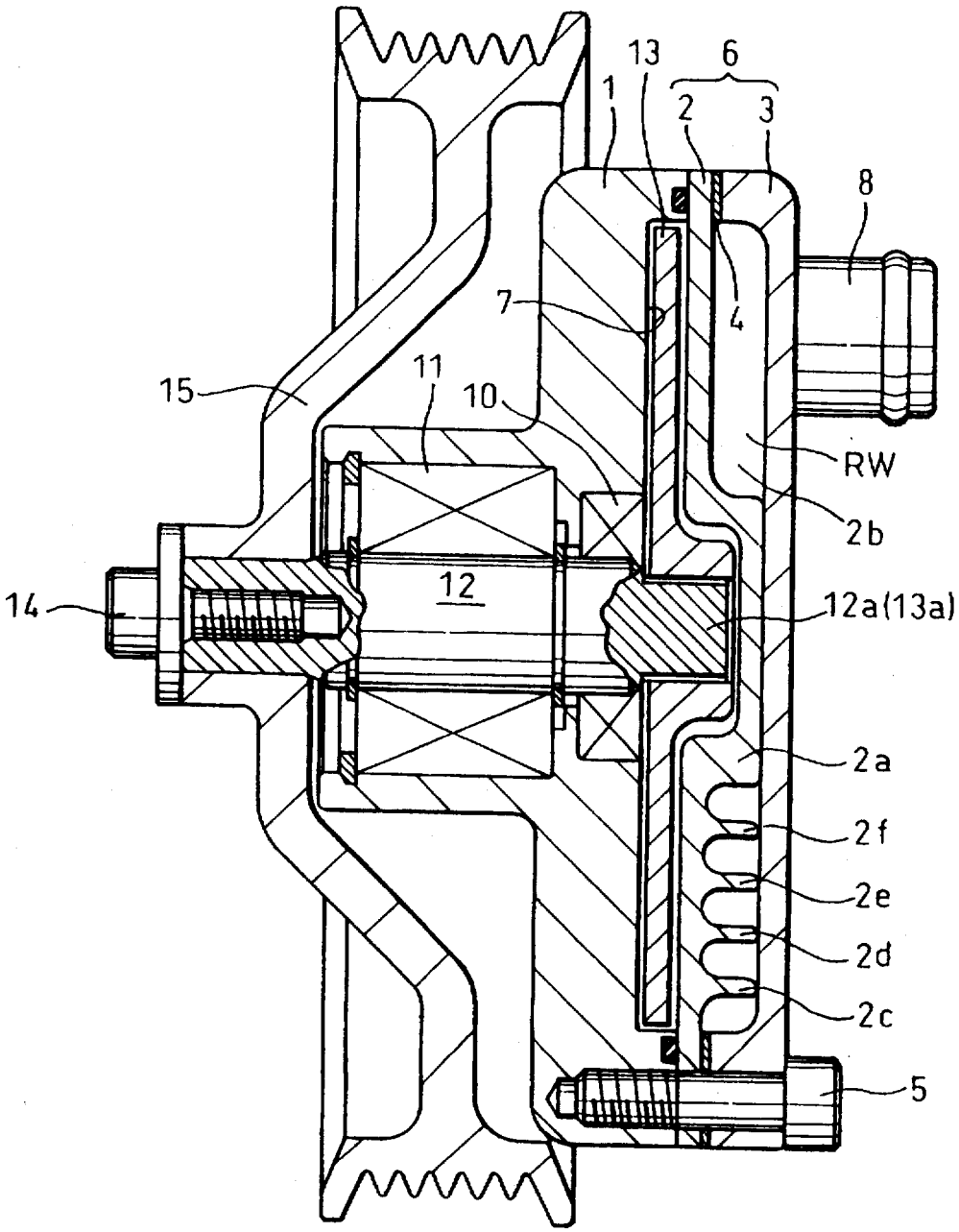
FIG. 1 is a longitudinal sectional view of a viscous fluid type heat generator in a first embodiment according to the present invention.

Referring to FIG. 1, the viscous fluid type heat generator has a front case 1, a rear case 6 having a rear plate 2 and a rear case element 3, and a gasket 4 placed between the rear plate 2 and the rear case element 3, which are fastened together with a plurality of through bolts 5. A heat generating chamber 7 is defined by the surface of a depression formed in the rear end surface of the front case 1 and the flat front end surface of the rear plate 2. A rear heat receiving chamber RW adjacent to the heat generating chamber 7 is defined by the rear end surface of the rear plate 2 and the inner surface of the rear case element 3.

An inlet port 8 for receiving water from an external heating circuit, not shown, and an outlet port, not shown, for sending water to the heating circuit are formed contiguously in the peripheral region of the rear wall of the rear case element 3. The inlet port 8 and the outlet port communicate with the rear heat receiving chamber RW.

A cylindrical protrusion 2*a* is formed in the central portion of the rear end surface of the rear plate 2, and a partition wall 2*b* is extended radially from the protrusion 2*a* so as to isolate the inlet port 8 and the outlet port. Four ridges 2*c*, 2*d*, 2*e* and 2*f* respectively having the shapes of circular arcs project axially from the rear end surface of the rear plate 2 in an angular range between a position near the inlet port 8 and a position near the outlet port. The protrusion 2*a*, the rear ends of the partition wall 2*b* and the ridges 2*c* to 2*f* are in contact with the inner surface of the rear case element 3. A shaft seal device 10 and a bearing device 11 are mounted on the front case 1. A drive shaft 12 is supported for rotation in the bearing device 11 and sealed from the heat generating chamber 7 by the shaft seal device 10.

External splines 12*a* are formed in a rear end portion of the drive shaft 12. The external splines 12*a* are fitted in internal splines 13*a* formed in a flat rotor 13 to form a spline fitting. As shown in FIG. 2, the spline fitting prohibits the rotation of the rotor 13 relative to the drive shaft 12 and permits the inclination of the rotor 13 to the axis O of the drive shaft 12 and the axial translation of the rotor 13 on the drive shaft 12. The rotor 13 rotates in the heat generating chamber 7 when the drive shaft 12 rotates.

A space between the surface defining the heat generating chamber 7 and the outer surface of the rotor 13 is filled up with silicone oil, i.e., a viscous fluid. As shown in FIG. 1, a pulley 15 is mounted on a front end portion of the drive shaft 12 and fastened to the drive shaft 12 with a bolt 14. The pulley 15 is driven for rotation, through a belt, by the engine of a vehicle.

When the viscous fluid type heat generator is incorporated into an automobile heating system, the drive shaft 12 is driven through the pulley 15 by the engine. Then, the rotor 13 mounted on the drive shaft 12 and restrained from rotation relative to the drive shaft 12 rotates in the heat generating chamber 7. Consequently, the silicone oil filling up the space between the surface defining the heat generating chamber 7 and the outer surface of the rotor 13 undergoes a shearing action and generates heat. The heat thus generated in the silicone oil is transferred to the water circulating through the rear heat receiving chamber RW, and the thus heated water is circulated through a heating circuit for heating the passenger chamber of the vehicle.

Figure 2:
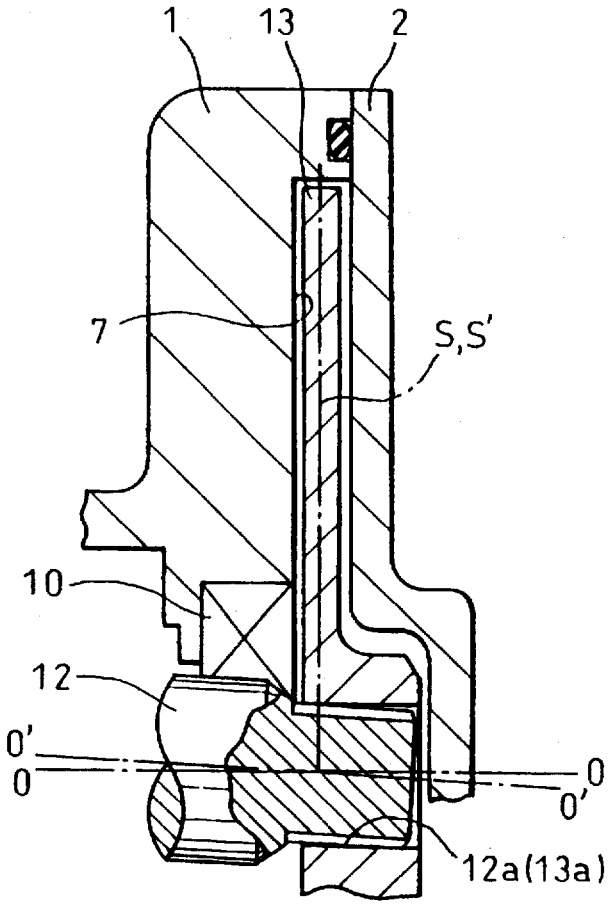
FIG. 2 is an enlarged sectional view of an essential portion of the viscous fluid type heat generator in the first embodiment.

When the viscous fluid type heat generator is operated, the drive shaft 12 is liable to be inclined by belt tension and to rotate about an axis O' inclined to an ideal axis with which the axis of the drive shaft 12 is aligned when no belt tension is applied to the pulley 15 as shown in FIG. 2. If the drive shaft 12 and the rotor 13 are not perfectly perpendicular to each other, the axes of the rotor 13 and the heat generating chamber 7 are not perfectly parallel to each other, and the axial dimensions of the rotor and the heat generating chamber do not match perfectly due to tolerances permitted on the dimensions of the components. However, since the rotor 13 is mounted on the drive shaft 12 so as to be able to incline to the axis "O", the inclination of the drive shaft can be absorbed. Since the rotor 13 is axially movable on the drive shaft 12, the difference between the axial dimensions of the rotor 13 and the heat generating chamber 7 can be absorbed. Consequently, the center plane "S" of the rotor 13 coincides substantially with the center plane "S'" of the heat generating chamber 7. Therefore, in this viscous fluid type heat generator, the surface defining the heat generating chamber 7 and the outer surface of the rotor 13 do not interfere with each other even if the clearance between the surface defining the heat generating chamber 7 and the outer surface of the rotor 13 is reduced to some extent to increase the quantity of heat generated by every full turn of the rotor 13. The silicone oil held in the space between the surface defining the heat generating chamber 7 and the outer surface of the rotor 13 can prevent direct contact between the surface defining the heat generating chamber 7 and the outer surface of the rotor 13 even if the rotor 13 inclines to the axis "O" or the rotor 13 is dislocated axially.

Figure 3:
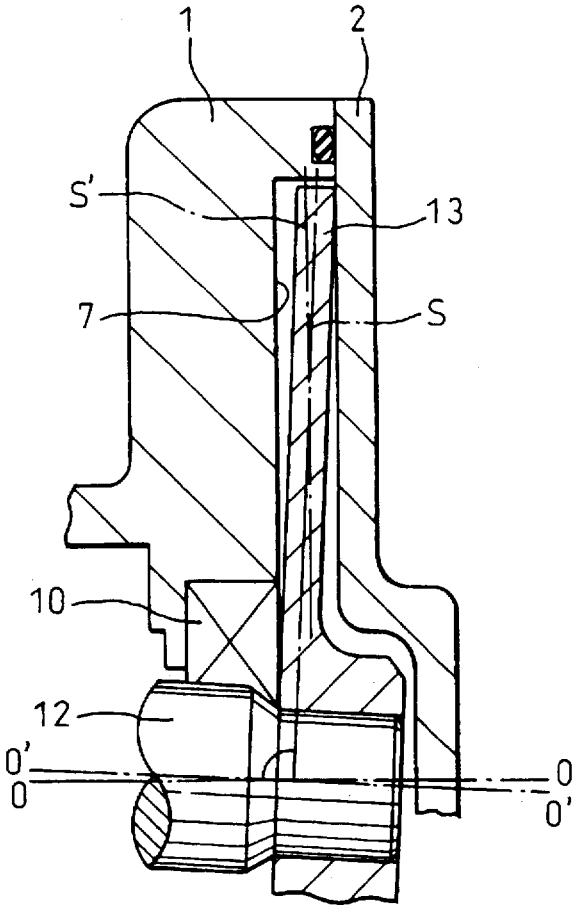
Fig. 3 PRIOR ART
FIG. 3 is an enlarged sectional view of an essential portion of a viscous fluid type heat generator in a comparative example.

In a viscous fluid type heat generator in a comparative example, a rear end portion of a drive shaft 12 is forced in the center bore of a rotor 13 in a press fit as shown in FIG. 3. Therefore, the rotor 13 is unable to turn relative to the drive shaft 12, unable to incline to the axis "O" of the drive shaft 12 and unable to move axially on the drive shaft 12. The rotor 13 is not mounted on the drive shaft 12 perfectly perpendicularly to the axis "O" of the drive shaft 12. Consequently, the inclination of the center plane "S" of the rotor 13 to the center plane "S'" of a heat generating chamber 7 cannot be absorbed, and the difference between the axial dimensions of the rotor 13 and the heat generating chamber 7 cannot be absorbed. Consequently, the outer surface of the rotor 13 and the surface defining the heat generating chamber 7 may interfere with each other when the clearance between the surface defining the heat generating chamber 7 and the outer surface of the rotor 13 is reduced to some extent.

Thus, the viscous fluid type heat generator in the first embodiment is able to prevent interference between the surface defining the heat generating chamber 7 and the outer surface of the rotor 13, securing a large quantity of heat generated by every full turn of the rotor 13, has a high heating ability and high durability. The drive shaft may be intermittently driven via a solenoid clutch.

(Second Embodiment)

Figure 4:
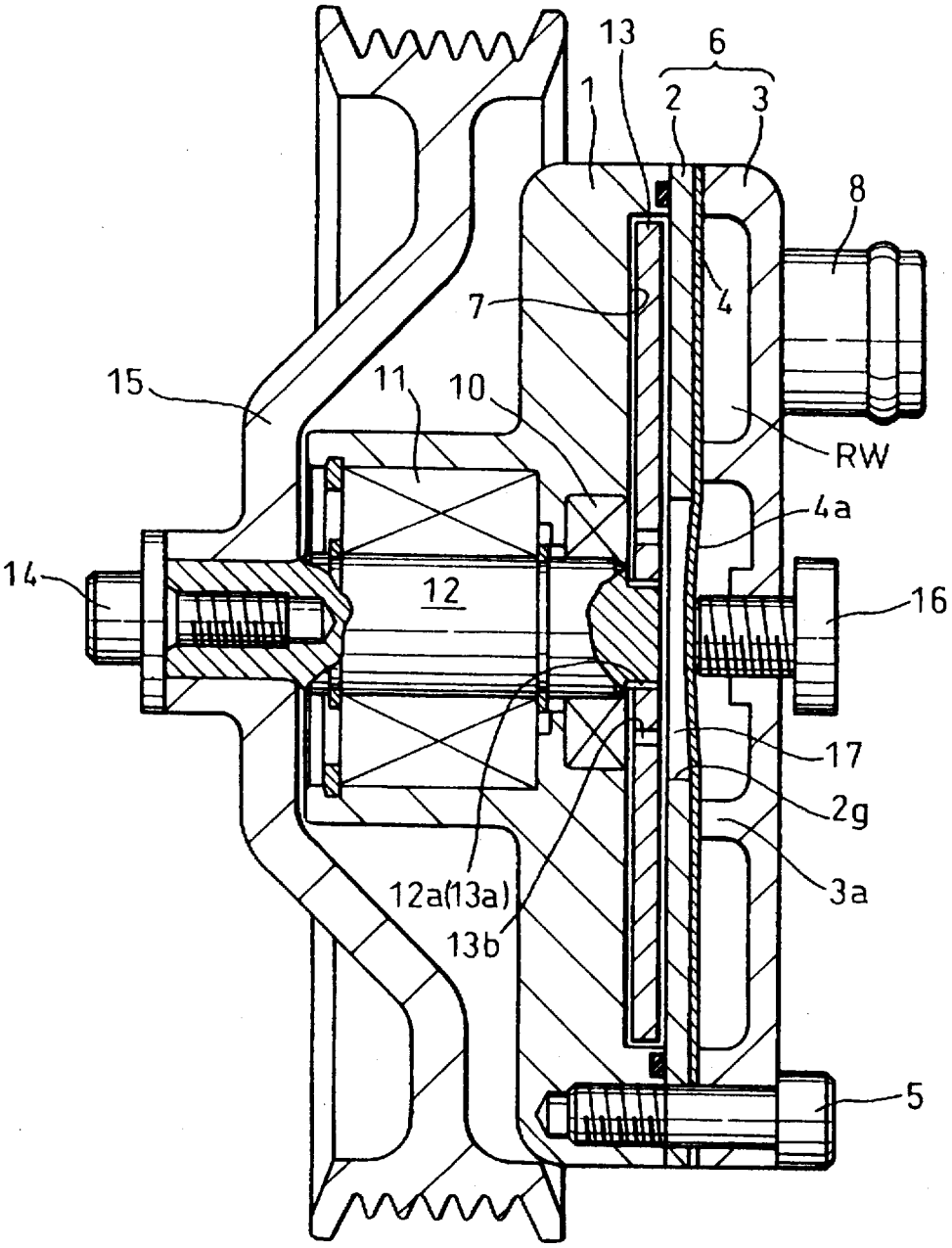
FIG. 4 is a longitudinal sectional view of a viscous fluid type heat generator in a second embodiment according to the present invention.

Referring to FIG. 4, a viscous fluid type heat generator according to a second embodiment of the present invention has a rotor 13 provided with a plurality of axial through-holes **13*b* in its central portion, an annular rear plate 2 provided with a central through-hole 2*g*, a rear case element 3 provided with an annular ridge 3*a* on the central region of its inner surface, and a gasket 4 integrally provided with a diaphragm 4*a* covering the through-hole 2*a* of the rear plate 2. An adjusting screw 16 is threadedly engaged in a central portion of the rear case element 3 to limit the rearward movement of the diaphragm 4*a*. Thus, a control chamber 17 communicating with the central region of a heat generating chamber 7 is formed on the front side of the diaphragm 4*a***. The second embodiment is the same in other respects as the first embodiment.

When the rotor 13 of the viscous fluid type heat generator is rotated and heat is generated excessively, the silicone oil filling up the heat generating chamber 7 moves the diaphragm **4*a* rearward by the Weissenberg effect to increase the volume of the control chamber 17. The rearward movement of the diaphragm 4*a* is limited by the adjusting screw 16. When the diaphragm 4*a* is moved rearward, the volume of the control chamber 17 increases and part of the silicone oil flows from the heat generating chamber 7 into the control chamber 17. Consequently, heat generation in the space between the surface defining the heat generating chamber 7 and the outer surface of the rotor 13 decreases. When the heat generating ability is thus reduced, the silicone oil is able to flow easily from the space between the front surface of the heat generating chamber 7 and the front surface of the rotor 13 through the through holes 13*b* into the control chamber 17**.

When heat is generated insufficiently, the adjusting screw 16 is screwed in by a necessary length to move the diaphragm **4*a* forward so that the volume of the control chamber 17 is decreased. Consequently, the silicone oil is supplied from the control chamber 17 into the heat generating chamber 7, whereby heat generation in the space between the surface defining the heat generating chamber 7 and the outer surface of the rotor 13** increases to enhance the heat generation.

When the heat generating ability is thus enhanced, the silicone oil is able to flow easily from the control chamber 17 into the space between the front surface of the heat generating chamber 7 and the front surface of the rotor 13 through the through holes **13*b***.

Thus, the heat generation of the viscous fluid type heat generator can surely be controlled and heat generating efficiency, after the use of the viscous fluid type heat generator for an extended period of operation, can be improved.

Direct contact between the outer surface of the rotor 13 and the surface defining the heat generating chamber 7 can be avoided by the silicone oil surely held in the central region of the space between the outer surface of the rotor 13 and the surface defining the heat generating chamber 7 by the Weissenberg effect, even if the rotor 13 inclines to the axis O of the drive shaft 12 or the same is axially dislocated.

(Modifications)

In the viscous fluid type heat generators in the first and the second embodiment, the drive shaft 12 and the rotor 13 are coupled by the spline fitting so that the rotor 13 is unable to turn relative to the drive shaft 12, able to incline to the axis O of the drive shaft 12 and able to move axially on the drive shaft 12. The modifications shown in FIGS. 5 and 6 are possible.

Figure 5:
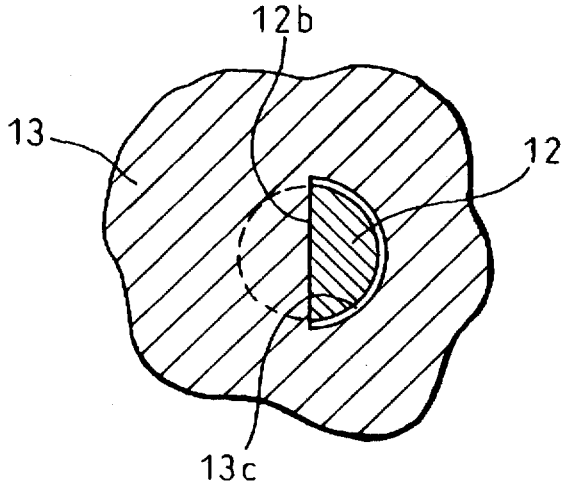
FIG. 5 is a fragmentary sectional view of a modified viscous fluid type heat generator.

In a modification shown in FIG. 5, the rotor 13 is mounted on the drive shaft 12 by a one-flat fitting. A rear end portion of the drive shaft 12 is cut in a semicylindrical shape having a flat surface **12*b*, and a semicylindrical hole 13*c* complementary to the semicylindrical rear end portion of the drive shaft 12 is formed in the rotor 13**. The one-flat fitting requires a process easier than that for forming the spline fitting and has the same function and effect as those of the spline fitting employed in the first and the second embodiment.

Figure 6:
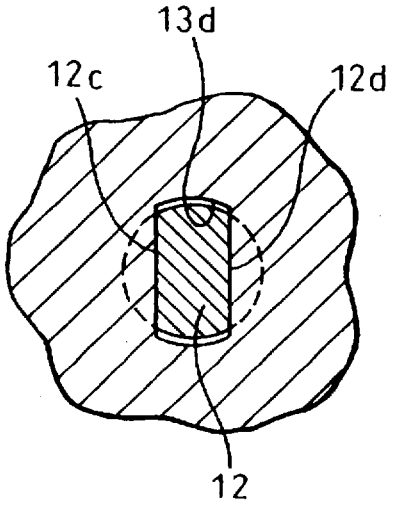
FIG. 6 is a fragmentary sectional view of an another modified viscous fluid type heat generator.

In another modification shown in FIG. 6, the rotor is mounted on the drive shaft 12 by a two-flat fitting. Two parallel flat surfaces **12*c* and 12*d* are formed in a rear end portion of the drive shaft 12, and a hole 13*a* having two parallel flat surfaces and complementary to the rear end portion of the drive shaft 12 is formed in the rotor 13**. The two-flat fitting requires a process easier than that for forming the spline fitting, is more reliable in torque transmission than the one-flat fitting and has the same function and effect as those of the spline fitting employed in the first and the second embodiment.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A viscous fluid type heat generator comprising:

a case means including a front case and a rear case which define, therein, a heat generating chamber having an inner surface;

a heat receiving chamber formed in at least one of said front and rear cases so as to extend contiguously with said heat generating chamber to form a heat exchanging fluid passage through which a heat exchanging fluid is circulated;

a drive shaft supported by said case means to be rotatable about an axis of rotation thereof;

a rotor element mounted on said drive shaft for rotation together in said heat generating chamber;

a viscous fluid, filling a space between said inner surface of said case means defining said heating chamber and an outer surface of said rotor element, for heat generation by the rotation of said rotor element; and a connecting means for connecting said rotor element to said drive shaft so that said rotor element is unable to turn relative to said drive shaft but is able to incline to the axis of rotation of said drive shaft and to move axially on said drive shaft.

2. The viscous fluid type heat generator according to claim 1, wherein said connecting means for connecting said rotor element to said drive shaft comprises a spline fitting connection.

3. The viscous fluid type heat generator according to claim 1, wherein the viscous fluid is held between said inner surface of said case means defining said heat generating chamber and the outer surface of said rotor element wherein said rotor element is in at least one state selected from the group consisting of inclined to the axis of rotation of said drive shaft and axially dislocated along said drive shaft.

4. The viscous fluid type heat generator according to claim 3, wherein said rear housing defining a control chamber therein communicating with a central region of said heat generating chamber and having a variable volume, an increase in the volume of said control chamber being caused by the Weissenberg effect on the viscous fluid while reducing heat generating ability in said heat generating chamber, and the viscous fluid being held in the space between said inner surface of said case defining said heat generating chamber and said outer surface of said rotor element by the Weissenberg effect on the viscous fluid when said rotor element is in at least one state selected from the group consisting of inclined to the axis of said drive shaft and axially dislocated along said drive shaft.

5. The viscous fluid type heat generator according to claim 4, wherein said control chamber of variable volume has a movable wall formed by a flexible member.

6. The viscous fluid type heat generator according to claim 5 further comprising a displacing means for displacing said flexible member defining said control chamber to increase and decrease said volume of said control chamber.

7. The viscous fluid type heat generator according to claim 6, wherein said displacing means is a screw member capable of being advanced and retracted by hand.

* * * * *